US009555469B2

(12) United States Patent
Idegomori et al.

(10) Patent No.: US 9,555,469 B2
(45) Date of Patent: Jan. 31, 2017

(54) ALUMINUM ALLOY CASTING AND METHOD FOR PRODUCING THE SAME, AND APPARATUS FOR PRODUCING SLIDE MEMBER

(71) Applicant: HONDA MOTOR CO., LTD., Tokyo (JP)

(72) Inventors: Takashi Idegomori, Utsunomiya (JP); Akio Shimoda, Utsunomiya (JP)

(73) Assignee: HONDA MOTOR CO., LTD., Tokyo (JP)

( * ) Notice: Subject to any disclaimer, the term of this patent is extended or adjusted under 35 U.S.C. 154(b) by 724 days.

(21) Appl. No.: 13/927,852

(22) Filed: Jun. 26, 2013

(65) Prior Publication Data

US 2013/0284392 A1 Oct. 31, 2013

Related U.S. Application Data

(62) Division of application No. 12/716,158, filed on Mar. 2, 2010, now abandoned.

(30) Foreign Application Priority Data

Mar. 9, 2009 (JP) ..... 2009-055494
Mar. 9, 2009 (JP) ..... 2009-055498

(51) Int. Cl.
*B22D 25/02* (2006.01)
*B22D 27/04* (2006.01)
(Continued)

(52) U.S. Cl.
CPC ..... *B22D 25/02* (2013.01); *B22D 1/00* (2013.01); *B22D 15/02* (2013.01); *B22D 21/007* (2013.01); *B22D 27/04* (2013.01); *B22D 27/08* (2013.01)

(58) Field of Classification Search
CPC ..... B22D 1/00; B22D 15/02; B22D 21/007; B22D 25/02; B22D 27/04; B22D 27/08
(Continued)

(56) References Cited

U.S. PATENT DOCUMENTS 4,973,363 A 11/1990 Hayato et al.
6,399,150 B1 * 6/2002 Yoshimura et al. .. H01F 41/026 335/306
(Continued)

FOREIGN PATENT DOCUMENTS

JP 58-116968 A 7/1983
JP 2000-042707 2/2000
(Continued)

OTHER PUBLICATIONS

Office Action, Japanese Patent Application No. 2009-055494 mailing date Jul. 2, 2013.
(Continued)

*Primary Examiner* — Kevin P Kerns
(74) *Attorney, Agent, or Firm* — Rankin, Hill & Clark LLP

(57) ABSTRACT

An aluminum alloy casting free from crack-causing needle-shaped crystallized substances, and an apparatus and a method for producing a slide member excellent in mechanical properties such as abrasion resistance are provided. A melt of an iron-containing aluminum alloy poured into a vessel in the completely liquid state is vibrated by a vibrating needle of a vibration applying unit, and then a core is inserted into the melt to cool the melt, whereby the aluminum alloy casting is produced as a sleeve of a slide member. The vibrating step is carried out at a frequency of 20 to 1000 Hz, and is continued until just before the melt is cooled to the solid-liquid coexisting temperature region.

4 Claims, 17 Drawing Sheets

(51) Int. Cl.

| | |
|---|---|
| ***B22D 27/08*** | (2006.01) |
| ***B22D 1/00*** | (2006.01) |
| ***B22D 15/02*** | (2006.01) |
| ***B22D 21/00*** | (2006.01) |

(58) Field of Classification Search
USPC ..... 164/71.1, 260, 122; 148/558
See application file for complete search history.

(56) References Cited

U.S. PATENT DOCUMENTS

| | | | | |
|---|---|---|---|---|
| 6,769,473 | B1 * | 8/2004 | Adachi et al. ..... | B22D 17/007 164/113 |
| 7,255,756 | B2 | 8/2007 | Tsao et al. | |

FOREIGN PATENT DOCUMENTS

| | | | |
|---|---|---|---|
| JP | 2000-073852 | A | 3/2000 |
| JP | 2000-109944 | A | 4/2000 |
| JP | 2002-096157 | A | 4/2002 |
| JP | 2007-216239 | A | 8/2007 |
| JP | 2008-155271 | A | 7/2008 |
| JP | 2008-279477 | A | 11/2008 |

OTHER PUBLICATIONS

Office Action, Japanese Patent Application No. 2009-055498 mailing date Jul. 2, 2013.
Japanese Notice of Allowance dated May 20, 2014 with partial English translation, 4 pages.
"Aluminum and Aluminum Alloys", ASM International, 1993, p. 43.

* cited by examiner

10 μm

100 μm

100 μm

ALUMINUM ALLOY CASTING AND METHOD FOR PRODUCING THE SAME, AND APPARATUS FOR PRODUCING SLIDE MEMBER

CROSS-REFERENCE TO RELATED APPLICATION

This application is a Divisional of U.S. application Ser. No. 12/716,158 (abandoned), filed Mar. 2, 2010, which claims the benefit of priority from the prior Japanese Patent Application Nos. 2009-055494 and 2009-055498, filed Mar. 9, 2009, the entire contents of which are incorporated herein by reference.

BACKGROUND OF THE INVENTION

1. Field of the Invention

The present invention relates to an aluminum alloy casting obtained by cooling and solidifying a melt of an aluminum alloy (an Al alloy), a method for producing the aluminum alloy casting, and an apparatus and a method for producing a slide member from a metal melt.

2. Description of the Related Art

In most of internal combustion engines, a cylindrical slide member (a sleeve) is inserted into a bore formed in a cylinder block, and a piston is reciprocated in the sleeve. When the piston is slidably in direct contact with the inner wall of the bore in the cylinder block, the inner wall may be abraded. The sleeve functions to prevent the abrasion of the inner wall.

When the cylinder block is produced by a casting method, the sleeve is disposed in a predetermined position in a cavity, and then a melt for forming the cylinder block is introduced to the cavity, whereby the sleeve is surrounded by the melt. Thus, a so-called cast coating (enveloped casting) is carried out to obtain the cylinder block containing the sleeve.

As a material for the sleeve, an Al—Si alloy having a high silicon (Si) content (a high-silicon alloy) is generally used because the alloy is lightweight, highly abrasion-resistant, and highly strong. However, the sleeve composed of the high-silicon alloy is not suitable for the cast coating with the melt for the cylinder block, whereby it is difficult to obtain a sufficient bond strength between the sleeve and the cylinder block.

The problem can be solved by using the high-silicon alloy also in the melt for the cylinder block. However, the high-silicon alloy is generally expensive, and thus this method is high in cost.

The above problem can be solved also by using in the sleeve an Al alloy such as an Al—Fe—Mn—Si alloy, which is suitable for the cast coating with respect to the cylinder block and is excellent in abrasion resistance.

However, when a melt of the Al—Fe—Mn—Si alloy is cast to produce the sleeve, the resultant casting (the sleeve) contains a needle-shaped coarse crystallized substance of an iron-based (Fe-based) intermetallic compound. The needle-shaped coarse crystallized substance can cause fracture, whereby the obtained sleeve cannot be sufficient in strength and toughness.

From this viewpoint, several studies have been made on miniaturization of the crystallized substance. For example, Japanese Laid-Open Patent Publication No. 2007-216239 discloses a technology containing the steps of ultrasonically vibrating the melt before the melt is cooled below the liquidus-line temperature (the solidification starting point), and then solidifying the melt.

In the case of using such ultrasonic vibration (at a frequency of 20 kHz or more) as described in the conventional technology of Japanese Laid-Open Patent Publication No. 2007-216239, though a large number of embryos can be generated, it is difficult to apply an energy sufficient for growing the embryos to crystal nuclei. Therefore, most of the embryos are remelted, whereby needle-shaped crystals of the Fe-based intermetallic compound are generated as shown in FIG. 9 of Japanese Laid-Open Patent Publication No. 2007-216239. As is clear from this, the conventional technology described in Japanese Laid-Open Patent Publication No. 2007-216239 is disadvantageous in that it is difficult to prevent the generation of the needle-shaped crystallized substance, which can cause fracture.

The applicant has proposed, in Japanese Laid-Open Patent Publication No. 2008-155271, a technology of vibrating the melt at a frequency of 1000 Hz or less when the temperature of the melt is higher than the solidification starting point but is lower than a temperature 10° C. higher than the solidification starting point.

By using the technology described in Japanese Laid-Open Patent Publication No. 2008-155271, the miniaturization of the crystallized substance can be achieved while reducing the generation of the needle-shaped crystal. Still there is a demand for further miniaturization.

The sleeve for the cylinder block can be produced by various methods. For example, a sleeve composed of an iron-based material is generally produced by a spin casting method. In this method, since the iron is relatively heavy, a large production apparatus may be required.

A sleeve composed of an Al alloy can be produced by a spray forming method or the like as a conventional technology described in Japanese Laid-Open Patent Publication No. 2000-109944. In this technology, a final extrusion process is needed to obtain the sleeve material.

Furthermore, a casting excellent in mechanical properties such as abrasion resistance can be produced by utilizing, for example, a centrifugal force for arranging hard metal compound grains on an outer surface of the casting (see Japanese Laid-Open Patent Publication No. 58-116968).

In the technology described in Japanese Laid-Open Patent Publication No. 2000-109944, higher cost, time, and effort may be required to produce the Al alloy sleeve because the final extrusion process is required.

The technology described in Japanese Laid-Open Patent Publication No. 58-116968 is designed only to improve the abrasion resistance of the outer circumferential surface of the casting, and the obtained slide member has only limited application. Thus, the casting cannot be used as the sleeve for the cylinder block, etc.

In the conventional technologies described in Japanese Laid-Open Patent Publication Nos. 2007-216239 and 2008-155271, the sleeve casting can be produced with improved mechanical properties by vibrating the Al alloy melt to miniaturize the cast metal structure. However, to use the casting as a slide member, the sliding surface of the casting should be excellent in abrasion resistance.

SUMMARY OF THE INVENTION

The present invention is related to Japanese Laid-Open Patent Publication No. 2008-155271, and an object of the present invention is to provide an aluminum alloy casting having a sufficiently fine crystallized structure free from needle-shaped crystallized substances, a method for producing the aluminum alloy casting, and an apparatus and a method for producing a slide member excellent in mechanical properties such as abrasion resistance.

According to a first aspect of the present invention, there is provided an aluminum alloy casting obtained by cooling a melt of an aluminum alloy containing iron. A metal structure of at least one surface in the aluminum alloy casting contains the iron in the state of a grain of pure iron or an iron-based intermetallic compound with another metal, and further contains a eutectic silicon having a greatest diameter of 10 μm or less in a two-dimensional surface. In the first aspect, the grain means an object having an aspect ratio (a ratio of the shortest diameter to the greatest diameter) of 0.5 or less.

Most of crystallized substances generated in the metal structure of the aluminum alloy casting of the first aspect are in the granular form. The metal structure is almost free from needle-shaped crystallized substances, which may act as an origin of cracking. Also the eutectic silicon is in the granular form with a small diameter. Thus, the aluminum alloy casting has the surface, which is not easily cracked, has excellent strength and toughness, and further has high abrasion resistance.

Preferred examples of such aluminum alloy castings include sleeves having inner and outer walls. In the sleeve, the inner wall corresponds to the above surface.

According to a second aspect of the present invention, there is provided a method for producing an aluminum alloy casting. The method comprises the steps of pouring a melt of an aluminum alloy containing iron into a vessel, vibrating the melt in the completely liquid state using a vibrator at a frequency of 20 to 1000 Hz until the melt is cooled to the solidification point, stopping the vibrating when the melt is cooled to the solidification point, and further cooling the melt at a cooling rate higher than that down to the solidification point, thereby solidifying the melt to obtain an aluminum alloy casting. A metal structure of at least one surface in the aluminum alloy casting contains the iron in the state of a grain of pure iron or an iron-based intermetallic compound with another metal, and further contains a eutectic silicon having a greatest diameter of 10 μm or less in a two-dimensional surface.

When the melt in the completely liquid state is vibrated, a large number of fine crystal nuclei or crystallization phase nuclei are formed, and an energy sufficient for growing the crystal nuclei is applied to the melt, whereby the generation of a needle-shaped crystallized substance is prevented. Thus, the aluminum alloy casting, which is almost free from the crack-causing needle-shaped crystallized substances and contains the small-diameter eutectic silicon grains as described above, can be easily produced by the method.

When the melt is cooled to the solidification starting point, a core having a temperature lower than that of the melt may be inserted into the melt. By using the core, the cooling rate can be increased, and a cavity corresponding to the shape of the core can be formed in the aluminum alloy casting. In this case, the core draws heat from the melt, whereby a portion in the melt, in contact with the core, is cooled at a high cooling rate.

Under the high cooling rate, the above fine crystal nuclei and crystallization phase nuclei are solidified while maintaining the fine dimension. Thus, the metal structure containing the fine crystallized substances can be easily formed by the method.

In the case of using the core, in the melt, a portion in contact with the core may be cooled at a cooling rate of 30° C./second or more, and a portion farthest from the core may be cooled at a cooling rate of 10° C./second or less. The metal structures formed in the portions are different from each other depending on the positions in the melt. Thus, a metal structure having desired properties can be formed at each position.

For example, a sleeve, which has an inner wall having a highly abrasion-resistant metal structure (the above described metal structure) and an outer wall having a metal structure suitable for casting a cylinder block therearound, can be produced as the aluminum alloy casting.

According to a third aspect of the present invention, there is provided an apparatus for producing a slide member. The apparatus comprises a vessel for storing a metal melt containing at least a base metal and a hard metal harder than the base metal, a vibration applying means for vibrating the metal melt in the vessel at a frequency of 1000 Hz or less, and a core that is inserted into the metal melt vibrated by the vibration applying means to cool the metal melt.

In the third aspect, when the metal melt is vibrated at a low frequency of 1000 Hz or less, crystallization phase nuclei are generated in the high-temperature region. When the metal melt is cooled by the core, a portion of the metal melt in contact with the core surface is cooled at a high cooling rate. As a result, fine hard metal crystal grains are generated in the portion. Thus, the portion of the metal melt in contact with the core surface has a fine hard metal structure containing fine crystallization phases and crystal grains. The fine hard structure can be formed on a sliding surface of the slide member by controlling the shape and position of the core inserted into the metal melt such that a portion corresponding to the sliding surface is rapidly cooled. The above simple apparatus is capable of producing such a slide member having a highly abrasion-resistant sliding surface.

The metal melt may be selected from various melts. For example, the base metal may be aluminum, and the hard metal may contain iron. In this case, the slide member can be used as a sleeve for a cylinder block.

In an embodiment of the production apparatus according to the third aspect of the present invention, the vibration applying means may contain a vibration generator and a vibrator. The vibration generator may have a rotor and an eccentric integrally rotatable with the rotor in an eccentric state with respect to the rotation axis of the rotor. The vibrator is connected to the vibration generator, extends in the rotation axis direction of the rotor, and is inserted into the metal melt.

In this embodiment, the rotor and the eccentric are integrally rotated to cause vibration in the vibration generator. The vibration in the vibration generator is transmitted to the vibrator. Since the vibrator extends in the rotation axis direction of the rotor, the vibrator is moved in the transverse direction. Therefore, the entire metal melt can be uniformly vibrated at a relatively large amplitude, and the crystallization phase nuclei can be efficiently formed.

In the present embodiment, the apparatus may further comprise a stage on which the vessel is placed, a conveying means for transferring the vessel placed on the stage to first and second positions, and an elevating means for raising and lowering the stage. The vibrator may be disposed at a position corresponding to the stage in the first position, and the core may be disposed at a position corresponding to the stage in the second position.

In the present embodiment, the vibrator and the core can be easily inserted into the metal melt by raising and lowering the stage. The vessel can be transferred to the first and second positions more easily with the conveying means than those without the conveying means. Furthermore, when the first and second positions are adjacent to each other, the entire production apparatus can have a smaller size, the vessel can be transferred in a shorter time, and the cycle time can be shorter, than when they are distant (unadjacent).

In another embodiment of the production apparatus of the third aspect, the vessel may comprise a heat insulation material. In this embodiment, a portion in the metal melt, in contact with the vessel, is cooled at a low cooling rate. Thus, when the slide member is enveloped by die casting, the portion and the die casting can have approximately the same metal structure, thereby resulting in excellent adhesion between the slide member and the die casting.

According to a fourth aspect of the present invention, there is provided a method for producing a slide member, comprising a vibration applying step of vibrating a metal melt placed in a vessel using a vibration applying means at a frequency of 1000 Hz or less, the metal melt containing at least a base metal and a hard metal harder than the base metal, and a core inserting step of inserting a core into the metal melt vibrated by the vibration applying means to cool the metal melt. The fourth aspect has the same advantageous effects as the third aspect.

In the present invention, the metal structure of at least one surface in the aluminum alloy casting contains the iron in the state of the grain of pure iron or an iron-based intermetallic compound with another metal, and further contains the eutectic silicon having a greatest diameter of 10 μm or less in a two-dimensional surface. As a result, the metal structure is almost free from the crack-causing needle-shaped crystallized substances, so that the aluminum alloy casting is not easily cracked and is excellent in properties such as strength and toughness.

Further, the greatest diameter of the eutectic Si is small, contributing to the improvement of properties such as abrasion resistance.

Furthermore, since the metal melt is cooled by the core after vibrated at a low frequency, the fine hard structure can be formed in the portion in contact with the core surface. Thus, using the above simple apparatus, the slide member having the highly abrasion-resistant sliding surface can be produced by controlling the shape and position of the core inserted into the metal melt such that a portion corresponding to the sliding surface is rapidly cooled.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A preferred embodiment of the aluminum alloy casting and the related production method of the present invention will be described in detail below with reference to the attached drawings.

Figure 1:
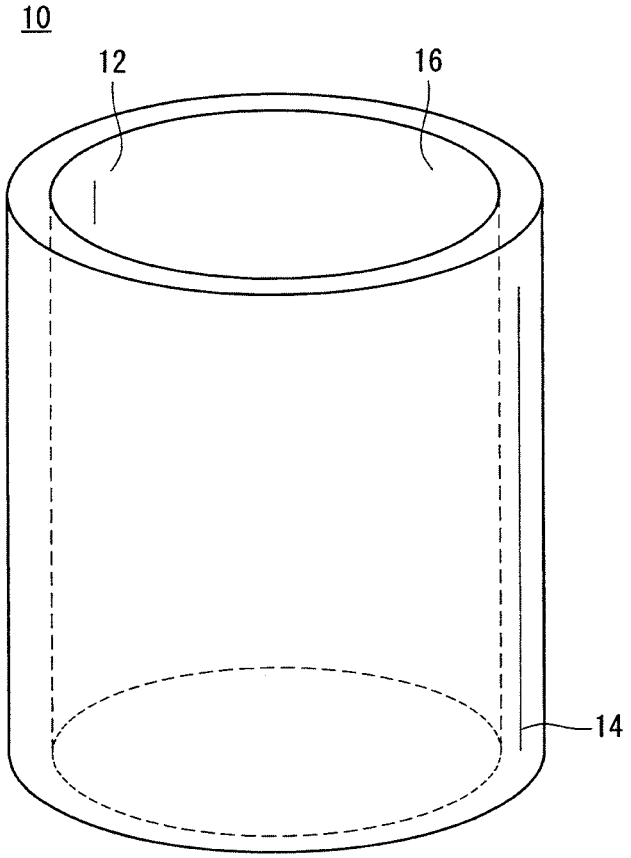
FIG. 1 is an overall, schematic, perspective view showing a sleeve as an Al alloy casting according to an embodiment of the present invention.

First an aluminum alloy casting according to the present embodiment will be described below with reference to FIGS. 1 to 3.

The aluminum alloy casting according to the present embodiment is used as a slide member (a sleeve). As shown in FIG. 1, the sleeve 10 has a cylindrical shape with an inner wall 12 and an outer wall 14. The sleeve 10 is inserted into a bore of a cylinder block (not shown) to protect the inner wall of the bore. Thus, an internal space 16 of the sleeve 10 acts as a cylinder bore in which a piston (not shown) is reciprocated.

The sleeve 10 is produced by inserting a core into a melt as described hereinafter. In the sleeve 10, the inner wall 12 is molded by the core, and the internal space 16 is formed by slightly grinding-processing the inner wall 12.

In this embodiment, the sleeve 10 is composed of an aluminum (Al) alloy containing iron (Fe). For example, the Al alloy may contain 2.0% to 4.0% of copper (Cu), 9.0% to 11.0% of silicon (Si), 0.3% to 0.8% of magnesium (Mg), 1.0% or less of zinc (Zn), 4.0% or less of Fe, 2.0% or less of manganese (Mn), 0.1% or less of nickel (Ni), 0.5% or less of titanium (Ti), and 0.1% or less of chromium (Cr), by weight, the balance being aluminum (Al). Preferred examples of such Al alloys include a 2.58% Cu-11.0% Si-0.55% Mg-0.014% Zn-2.02% Fe-1.10% Mn-0.003% Ni-0.007% Ti-0.002% Cr—Al alloy.

Figure 2:
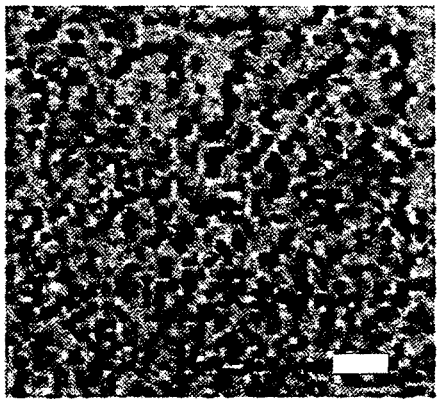
FIG. 2 is an optical micrograph showing a metal structure of an inner wall in the sleeve.
Figure 3:
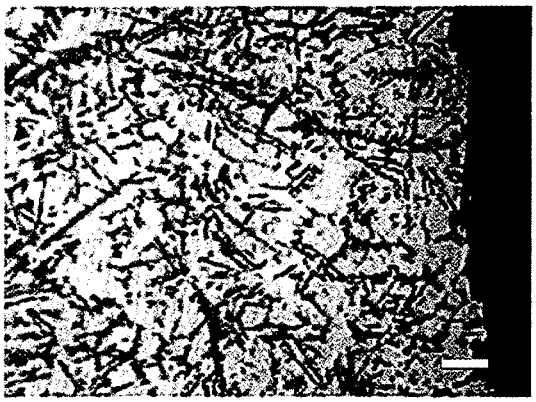
FIG. 3 is an optical micrograph showing a metal structure of an outer wall in the sleeve.
Figure 5:
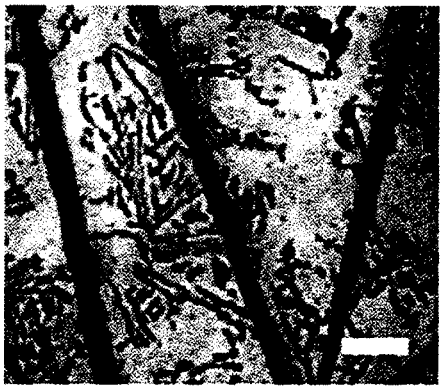
FIG. 5 is an optical micrograph showing a metal structure of an Al alloy casting produced by cooling and solidifying a melt without applying vibration.

FIG. 2 is an optical micrograph showing a metal structure of the inner wall 12 in the sleeve 10. As shown in FIG. 2, in the metal structure of the inner wall 12, crystallized substance grains having aspect ratios of 0.5 or less are dispersed in the matrix. The white rectangle shown in FIG. 2 is a scale having a length corresponding to 10 μm in the longitudinal direction. Although each white rectangle shown in FIGS. 3 and 5 is also a scale, the scale corresponds to 100 μm.

In the case of using the Al alloy having the above composition, the crystallized substance grains include Fe—Mn-based intermetallic compound grains and eutectic silicon (eutectic Si) grains. Thus, in the present embodiment, the Fe—Mn-based intermetallic compound and the eutectic Si are both in the form of fine crystal grains. Each crystal grain of the Fe—Mn-based intermetallic compound and the eutectic Si has a greatest diameter of 10 μm or less in a two-dimensional surface.

In the sleeve 10, the metal structure of the inner wall 12 contains the crystallized substance grains with remarkably small diameters. The metal structure is free from needle-shaped crystallized substances, which often cause cracking, whereby the inner wall 12 is not easily cracked. Thus, the sleeve 10 is excellent in various properties such as abrasion resistance, strength, and toughness.

Though the outer wall 14 may have the same metal structure as the inner wall 12, the outer wall 14 preferably has a metal structure suitable for casting a melt for the cylinder block around the outer wall 14. An optical micrograph of such a metal structure is shown in FIG. 3.

An apparatus for producing the sleeve will be described below with reference to FIG. 4.

Figure 4:
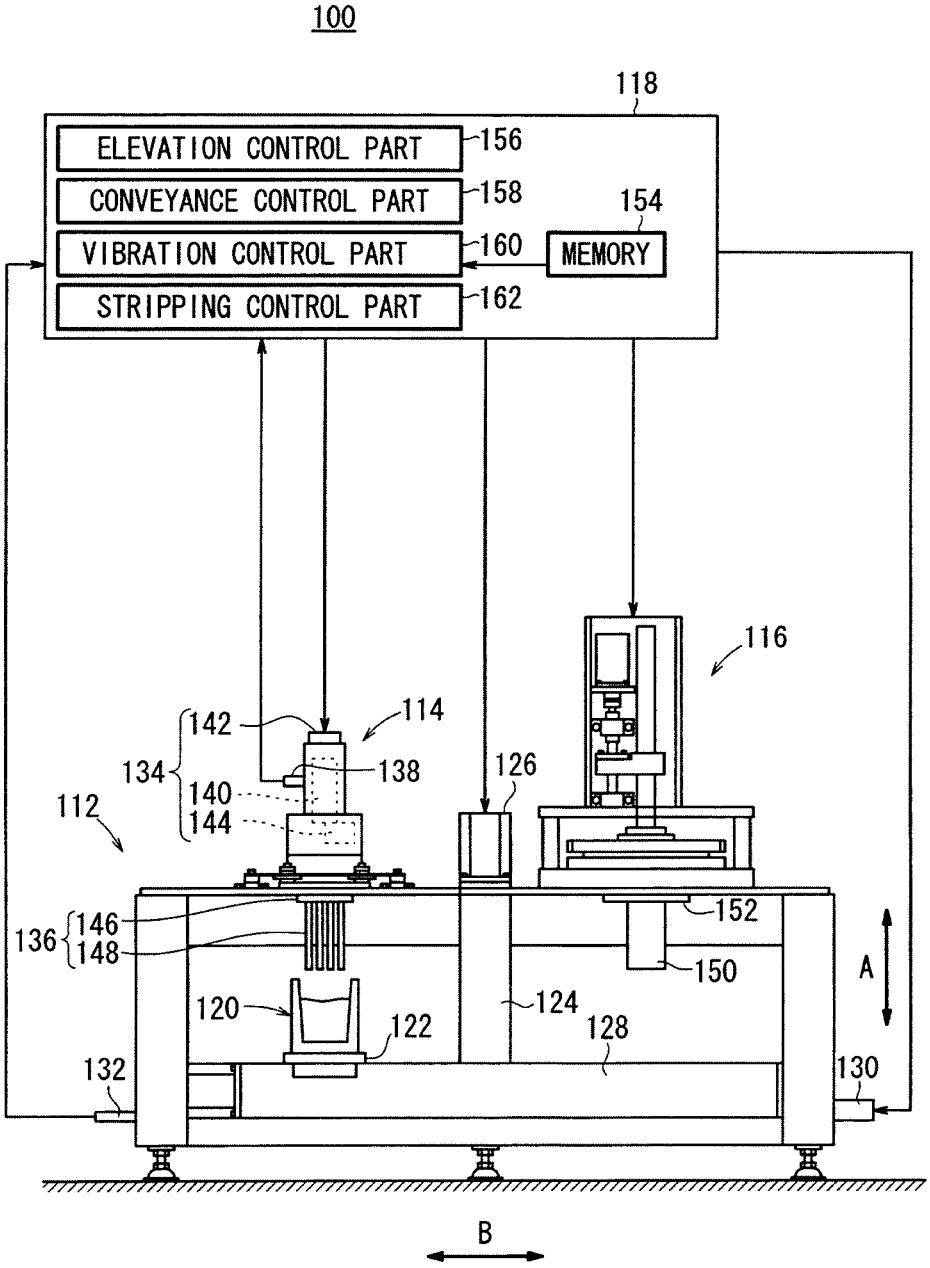
FIG. 4 is a view showing a principal part of a sleeve producing apparatus according to the present embodiment.

As shown in FIG. 4, a production apparatus 100 has a main body 112, a vibration applying unit 114, a core inserting unit 116, and a control unit 118.

The main body 112 acts as a base of the production apparatus 100, and is placed on a floor in a factory, etc. The main body 112 has a vessel (mold) 120, a stage 122, an elevating mechanism 124, an elevating motor 126, a conveying mechanism 128, a conveying motor 130, and a weighing part 132.

A metal melt containing a base metal and a hard metal (hereinafter referred to as the melt) is contained in the vessel 120. The base metal is aluminum. The hard metal is harder than the base metal and contains iron. Thus, the melt is composed of an Al alloy containing at least iron. The Al alloy may have the same composition as the above described material for the sleeve 10.

The vessel 120 is composed of a heat insulation material. The heat insulation material may be LUMIBOARD®, sand, ceramic fiber (IBIWOOL®), etc. In a case where the sleeve 10 produced by the apparatus 100 of the present embodiment is enveloped by die casting, the heat insulation material is selected such that the rate of cooling a portion of the melt for the sleeve 10, which is in contact with the heat insulation material, is approximately the same as the rate of cooling a melt in die casting. The vessel 120 is removable from the stage 122.

The elevating mechanism 124 raises and lowers the stage 122 using the elevating motor 126 in the direction of the arrow A shown in FIG. 4. The conveying mechanism 128 transfers the stage 122 using the conveying motor 130 horizontally in the direction of the arrow B shown in FIG. 4. The stage 122 is transferred by the conveying motor 130 from a first position (a position of the stage 122, shown by a dashed-two dotted line in FIG. 9) to a second position (a position of the stage 122, shown by a solid line in FIG. 9). For example, the elevating mechanism 124 and the conveying mechanism 128 may be a feed screw mechanism. The first and second positions are adjacent to each other.

The weighing part 132 outputs a signal depending on the weight of the melt in the vessel 120 placed on the stage 122.

The vibration applying unit 114 is capable of vibrating the melt in the vessel 120. The vibration applying unit 114 has a vibration generator 134, a vibrator 136, and a temperature detector 138.

The vibration generator 134 generates vibration at a frequency of 1000 Hz or less (a low frequency). The frequency is preferably 20 to 1000 Hz. When the frequency is less than 20 Hz, the resultant metal structure contains extremely coarse needle crystals of an Fe—Mn-based intermetallic compound as shown in FIG. 5, which is an optical micrograph showing a structure of a casting produced by conventional solidification without vibration. Therefore, there is fear that the obtained metal structure may disadvantageously be cracked. On the other hand, when the frequency is more than 1000 Hz, generated embryos are remelted due to the high frequency, so that the resultant metal structure often contains needle crystals of the Fe—Mn-based intermetallic compound, which are observed in the structure produced by the conventional solidification. Therefore, also in this case, the obtained metal structure may disadvantageously be cracked.

Specifically, the vibration frequency may be 90 Hz, 200 Hz, 450 Hz, etc. though not restrictive.

The vibration generator 134 has a rotor 140, a rotating motor 142, and an eccentric 144. The rotor 140 is rotated by the rotating motor 142. The rotating motor 142 may be an electric motor or an air motor. The eccentric 144 is rotatable integrally with the rotor 140, in an eccentric state with respect to the rotation axis of the rotor 140.

The vibrator 136 is disposed in a position facing the stage 122 in the first position. The vibrator 136 has a support 146 connected to the vibration generator 134, and further has a plurality of vibrating needles 148 connected to the support 146. The vibrating needles 148 are inserted into the melt.

Figure 6:
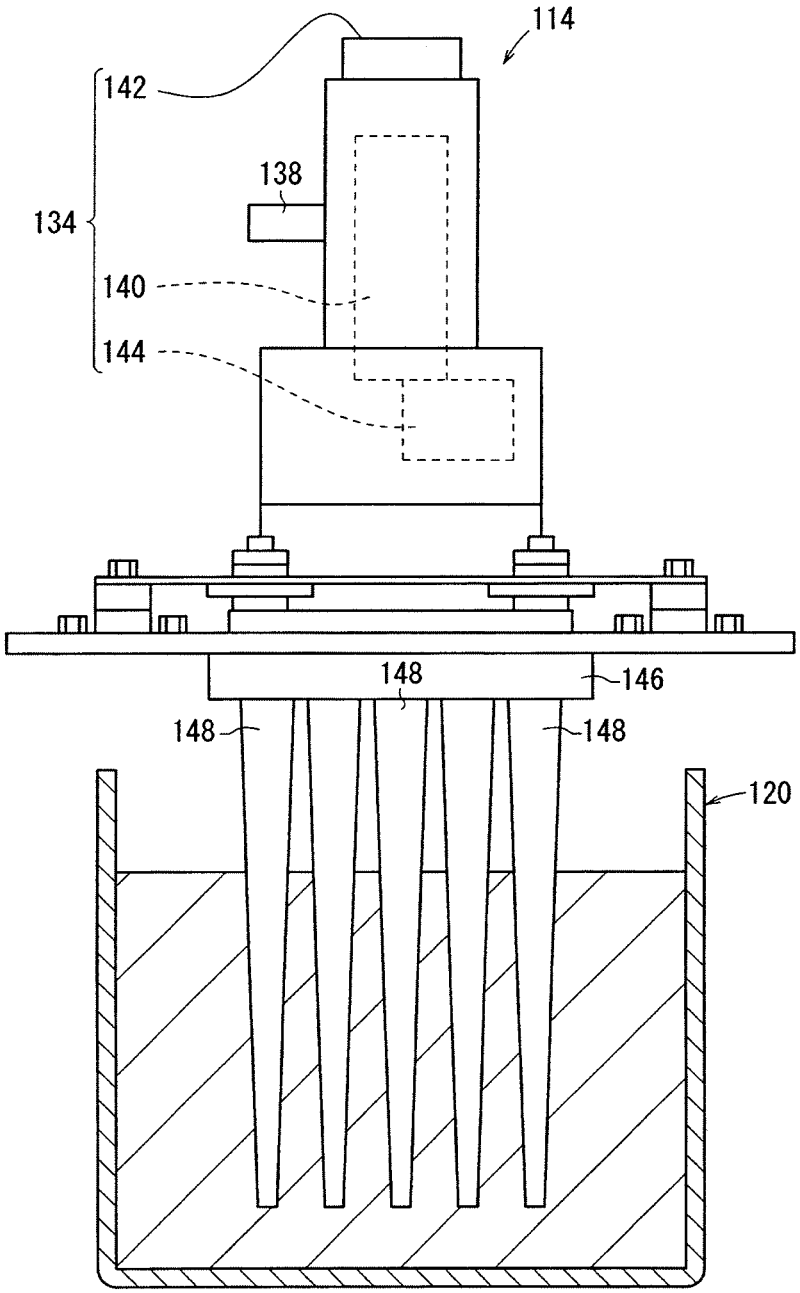
FIG. 6 is a schematic vertical cross-sectional view showing vibrating needles immersed in a melt in a vessel to produce the sleeve.

As shown in FIGS. 4 and 6, the vibrating needles 148 extend straightly in the rotation axis direction of the rotor 140, and have circular cross sections.

The vibrating needles 148 are disposed at a certain interval. The interval is controlled such that the vibrating needles 148 are not brought into contact with each other during the vibration.

The vibrating needles 148 are composed of a ceramic or a heat-resistant metal material, thereby being sufficiently resistant against heat of the melt. The diameter and number of the vibrating needles 148 are selected such that the occupancy of the vibrating needles 148 in the melt is 15% to 30% (the volume ratio of immersed portions of the vibrating needles to the melt).

The occupancy of the vibrating needles 148 in the melt is controlled within the range of 15% to 30% such that the nucleus generation is increased. The nucleus generation increase is evaluated based on the area ratio of the total area of fine crystal grains having diameters within a predetermined range in an area (e.g. 5 mm×5 mm) of a solidified casting 200.

Specifically, when the area ratio of the fine crystal grains is 70% or more, the nucleus generation is considered to be increased. When the area ratio of the fine crystal grains is less than 70%, the nucleus generation is not considered to be increased.

In this embodiment, when the occupancy of the vibrating needles 148 in the melt is 15% or more, the area ratio of the fine crystal grains is 70% or more. Thus, the lower limit of the occupancy of the vibrating needles 148 is 15% in the melt. Also the alloy composition unevenness in the casting process is considered to determine the lower limit. The area ratio of the fine crystal grains can be obtained by the steps of observing the metal structure of the casting 200 using an optical microscope, measuring the diameters of the crystal grains to identify the fine crystal grains, and performing an image processing to quantify the area ratio.

When the melt is vibrated, aluminum or the like is attached to the surfaces of the vibrating needles 148. Therefore, it is necessary to clean the surfaces of the vibrating needles 148 to remove the aluminum or the like attached to the surfaces. In is preferred that the vibrating needles 148 are disposed at a certain interval in the cleaning. When the interval between the vibrating needles 148 is too small, the cleaning cannot be efficiently carried out, and the cycle time is often increased. The upper limit of the occupancy of the vibrating needles 148 in the melt is 30% in view of maintaining a satisfactory distance between the vibrating needles 148.

As shown in FIG. 4, the core inserting unit 116 is disposed in a position facing the stage 122 in the second position, to cool the melt in the vessel 120. The core inserting unit 116 has a core 150 that is inserted into the melt and a stripper ring 152 for removing the core 150 from the solidified casting 200.

The core 150 has a shape corresponding to the sleeve for the cylinder block (an approximately cylindrical shape). Specifically, the core 150 is formed in an inverted trapezoidal cone shape (see FIGS. 12 and 13). The core 150 may be composed of a material having an excellent thermal conductivity such as a copper-based or copper-chromium-based material, and has a temperature within the range of ordinary temperature to 200° C. The size of the core 150 is such that when the core 150 is inserted into the melt in the vessel 120, a certain space is formed between the outer surface of the core 150 and the inner surface of the vessel 120 (see FIGS. 12 and 13).

The stripper ring 152 is disposed on the outer surface of the core 150, and can be moved in the longitudinal direction of the core 150.

The control unit 118 is used to control the elevating motor 126, the conveying motor 130, the rotating motor 142, and the core inserting unit 116. The control unit 118 has a memory 154, an elevation control part 156, a conveyance control part 158, a vibration control part 160, and a stripping control part 162.

Melt requirement mapping data and vibrating temperature range mapping data are stored in the memory 154. The melt requirement mapping data include the relation between the weight of the slide member and the required amount of the melt. The vibrating temperature range mapping data include the relation between the type (material) of the melt and the vibrating temperature range.

The elevation control part 156 is used for operating the elevating motor 126, thereby raising and lowering the stage 122.

The conveyance control part 158 is used for operating the conveying motor 130, thereby horizontally transferring the stage 122.

The vibration control part 160 is used for operating the rotating motor 142, thereby vibrating the melt. The rotation speed of the rotating motor 142 is controlled such that the melt is vibrated at a frequency of 20 to 1000 Hz. The period of time, for which the melt is vibrated, is determined based on a vibrating temperature range and a detected temperature obtained from a signal from the temperature detector 138. The vibrating temperature range is obtained from the vibrating temperature range mapping data in the memory 154.

The stripping control part 162 is used for moving the stripper ring 152, thereby removing the core 150 from the solidified casting 200.

A method for producing the sleeve 10 according to the present embodiment will be described below with reference to FIG. 4 and FIGS. 7 to 16.

First, as shown in FIG. 4, the vessel 120 is placed on the stage 122 in the first position, and the melt in the completely liquid state is added to the vessel 120. In this step, the weight of the melt in the vessel 120 is measured by the weighing part 132. The weight of the melt is detected using a signal output from the weighing part 132.

The melt in the completely liquid state may be added to the vessel 120, or alternatively the melt in the solid-liquid coexisting state may be converted to the completely liquid state by heating in the vessel 120.

The weighing part 132 outputs a signal depending on the melt poured into the vessel 120 placed on the stage 122. When the detected weight reaches the required weight (when pouring the melt into the vessel 120 is finished), the measurement of the melt weight is stopped. The required amount value of the melt is obtained from the memory 154.

Figure 7:
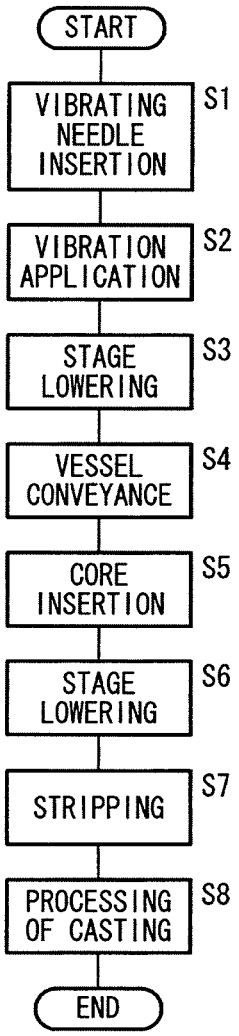
FIG. 7 is a flow chart showing sleeve producing procedures according to the present embodiment.
Figure 8:
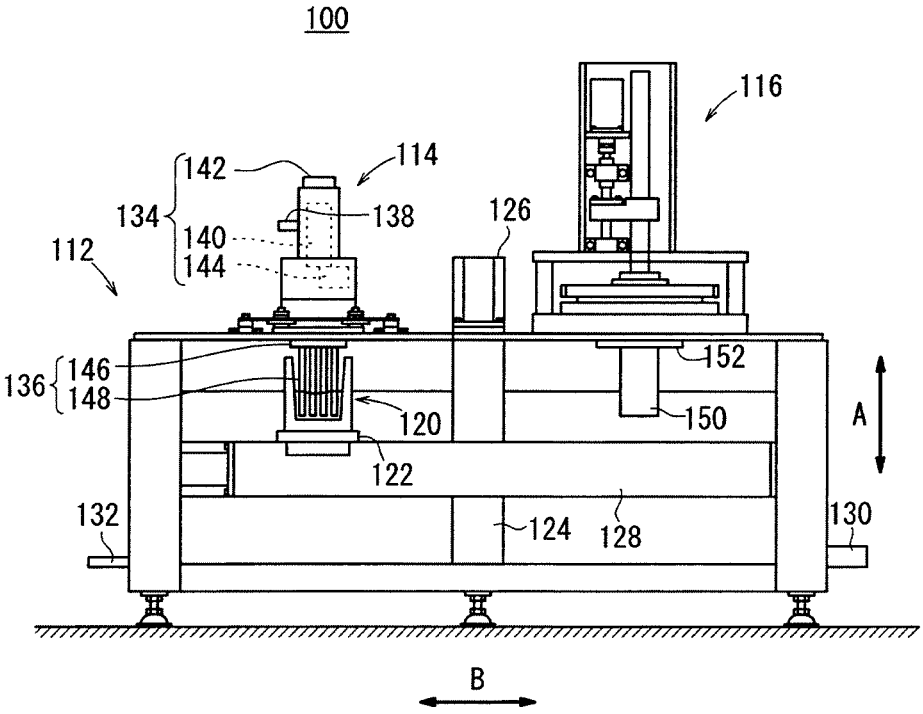
FIG. 8 is a view showing the step of vibrating the melt.

As shown in FIG. 8, the stage 122 is raised by the elevation control part 156, whereby the vibrating needles 148 are inserted (immersed) into the melt (the step S1 of FIG. 7).

The rotating motor 142 is rotated by the vibration control part 160, whereby the melt is vibrated for a predetermined vibrating time (the step S2). In this step, the temperature of the melt is detected by the temperature detector 138, and whether the detected temperature is within the vibrating temperature range is judged by the control unit 118. When the detected temperature is within the vibrating temperature range, the rotating motor 142 is operated by the vibration control part 160 to vibrate the melt. When the detected temperature is not within the vibrating temperature range, the operation of the rotating motor 142 is stopped by the vibration control part 160 to stop the vibration.

In this manner, the melt is vibrated by the vibration control part 160 immediately after the vibrating needles 148 are immersed in the melt until just before the melt is cooled to the solidification starting point and converted to the solid-liquid coexisting state. In other words, in this embodiment, the melt is vibrated while the temperature of the melt is changed from the completely liquid state temperature region to the upper limit of the solid-liquid coexisting state temperature region.

In the method of Japanese Laid-Open Patent Publication No. 2008-155271, the vibration generator 134 is driven when the melt is cooled to a temperature 10° C. higher than the solidification starting point, in other words, when the temperature of the melt is within the solid-liquid coexisting temperature region. In contrast, in this embodiment, the vibration generator 134 is driven when the melt is in the completely liquid state. The vibration generator 134 shows an oscillatory frequency of 20 to 1000 Hz.

In the case of using the melt composed of the 2.58% Cu-11.0% Si-0.55% Mg-0.014% Zn-2.02% Fe-1.10% Mn-0.003% Ni-0.007% Ti-0.002% Cr—Al alloy, the melt has a solidification starting point of 681° C. The melt is poured into the vessel 120 when it has a temperature of 850° C. In this case, the melt is vibrated after being poured until just before it is cooled to the solidification starting point. Thus, crystallization phase nuclei are generated in the high-temperature region of the melt.

Figure 9:
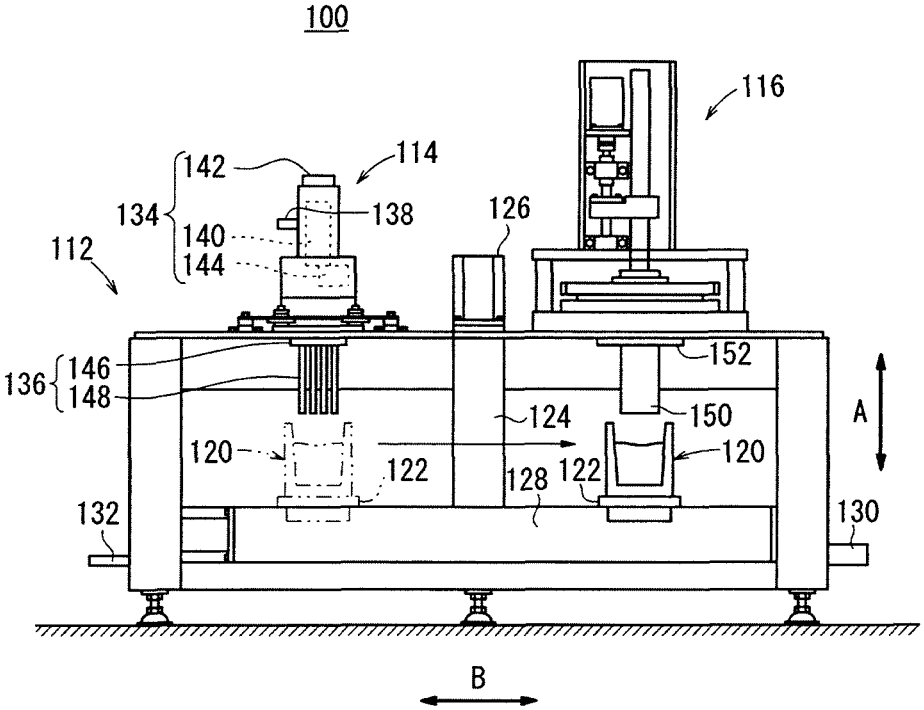
FIG. 9 is a view showing the step of transferring a stage from a first position to a second position.
Figure 10:
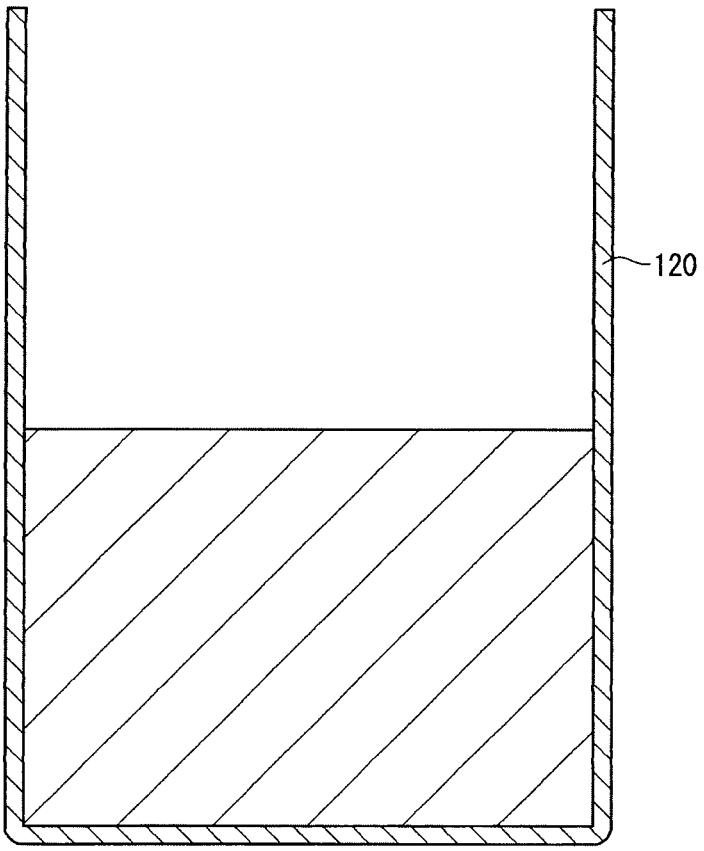
FIG. 10 is a schematic vertical cross-sectional view showing the melt after removing the vibrating needles shown in FIG. 8.

As shown in FIG. 9, the stage 122 is lowered by the elevation control part 156, so that the vessel 120 is returned to the first position (the step S3). Thus, the vibrating needles 148 are brought out from the melt at the solidification starting point as shown in FIG. 10. The melt in the vessel 120 contains fine crystal nuclei and fine crystallization phase nuclei (both not shown).

The stage 122 is horizontally moved by the conveyance control part 158, so that the vessel 120 is transferred from the first position to the second position (the step S4).

Figure 11:
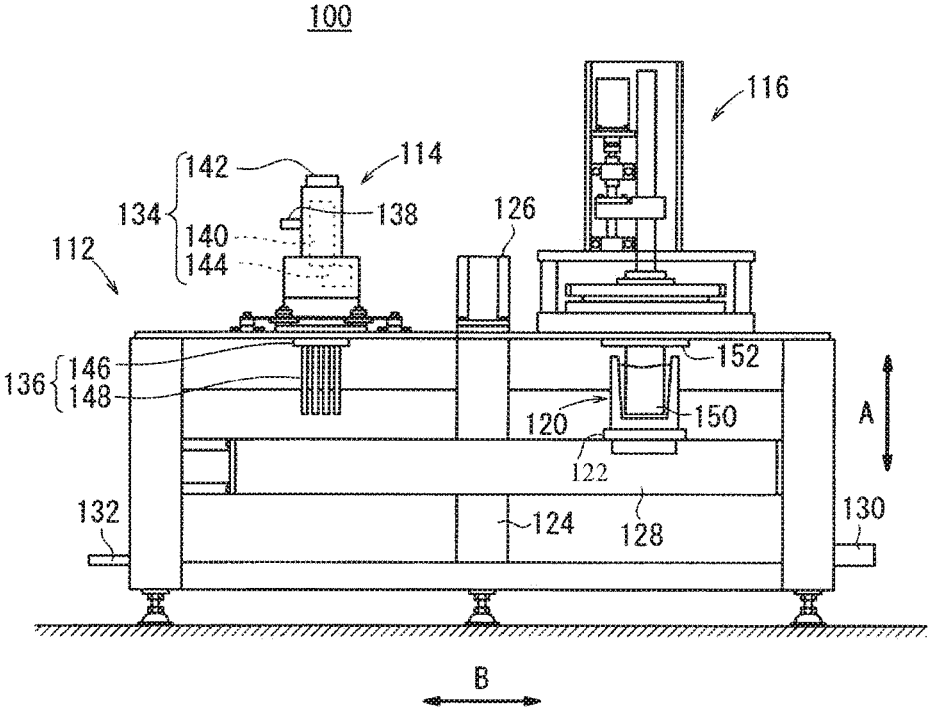
FIG. 11 is a view showing the step of inserting a core into the melt.
Figure 12:
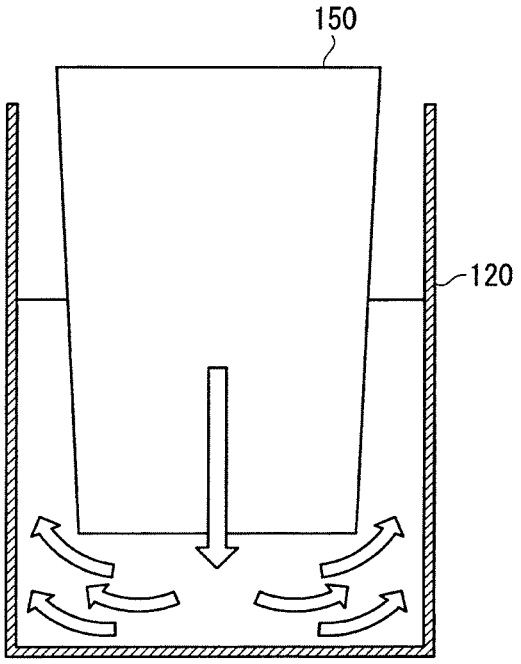
FIG. 12 is a schematic vertical cross-sectional view showing the start of inserting the core into the melt.
Figure 13:
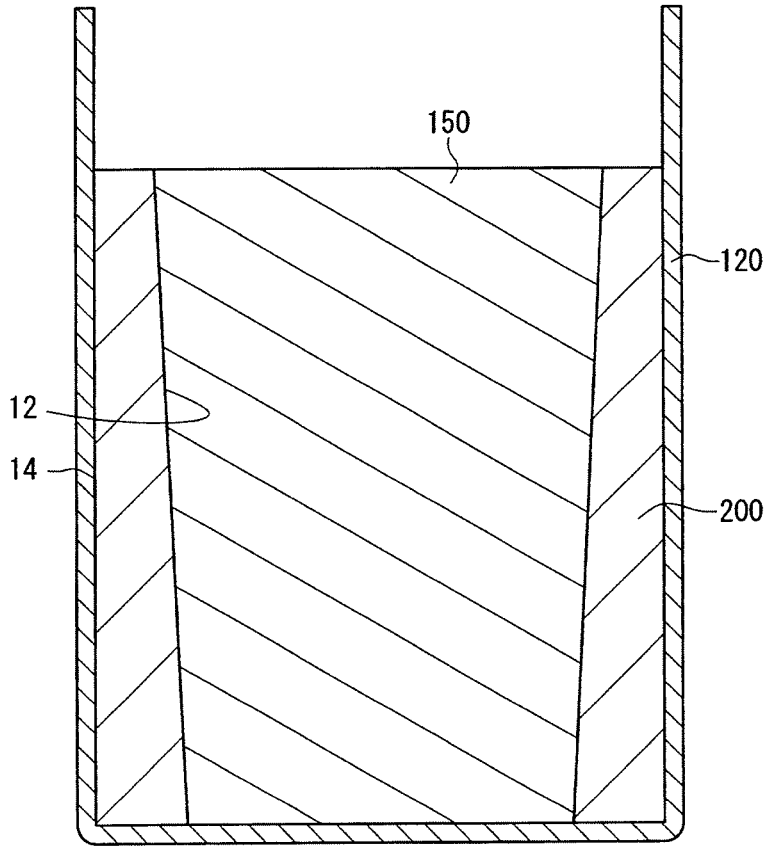
FIG. 13 is a schematic vertical cross-sectional view showing the completion of inserting the core into the melt.

As shown in FIG. 11, the stage 122 is raised by the elevation control part 156, so that the core 150 is inserted into the melt (the step S5). When the core 150 is inserted, the melt flows into the space between the core 150 and the vessel 120 as shown in FIG. 12. The melt is solidified in the state shown in FIG. 13. In the melt, a portion in contact with the core 150 corresponds to the inner wall 12 of the sleeve 10, and a portion in contact with the vessel 120 corresponds to the outer wall 14 of the sleeve 10. Thus, in the following description, the portion in contact with the core 150 may be referred to as the inner wall 12, and the portion in contact with the vessel 120 may be referred to as the outer wall 14.

As is clear from the above description, the melt composed of the 2.58% Cu-11.0% Si-0.55% Mg-0.014% Zn-2.02% Fe-1.10% Mn-0.003% Ni-0.007% Ti-0.002% Cr—Al alloy has a temperature around the solidification starting point 681° C. when the core 150 is inserted. The core 150 has a temperature within the range of ordinary temperature to 200° C. Furthermore, the core 150 is composed of a material having an excellent thermal conductivity as described above. Thus, heat in the inner wall 12 of the melt is readily transferred to the core 150 and removed. By the heat removal, the inner wall 12 is cooled more rapidly than the outer wall 14. Meanwhile, the vessel 120 is generally heated, whereby the outer wall 14 is cooled at approximately the same rate as the natural cooling rate.

The inner wall 12 is cooled at a cooling rate higher than that of the outer wall 14. For example, by controlling the contact area between the melt and the core 150, the temperature of the core 150, the amount of the melt, or the like, the inner wall 12 may be cooled at a cooling rate of 30° C./second or more, and the outer wall 14 (the portion farthest from the core 150) may be cooled at a cooling rate of 10° C./second or less. In a typical example, the inner wall 12 is cooled at a cooling rate of 30° C. to 50° C., and the outer wall 14 is cooled at a cooling rate of 1° C. or lower, per second. FIG. 2 shows the metal structure of the inner wall 12 cooled at a rate of 37° C./second, and FIG. 3 shows the metal structure of the outer wall 14 cooled at a rate of 0.4° C./second.

On the inner wall 12, which is cooled at such a high cooling rate, the crystal nuclei and crystallization phase nuclei are not readily grown, and are solidified while maintaining the small dimension. Thus, in the resultant metal structure, the crystallized Fe—Mn-based intermetallic compound is in a grain state, and the eutectic Si has a greatest diameter of 10 μm or less in a two-dimensional surface.

Figure 14:
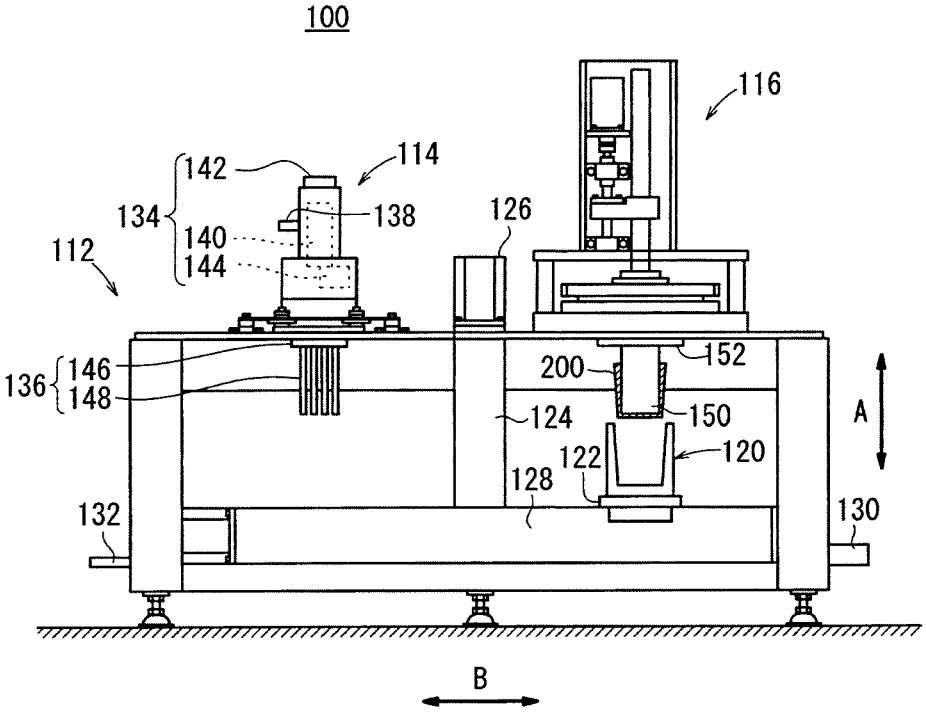
FIG. 14 is a view showing the step of detaching the casting from the vessel.

As shown in FIG. 14, at the completion of the casting process, the stage 122 is lowered by the elevation control part 156, so that the vessel 120 is arranged in the second position (the step S6). The completion of the casting process means that a time required for solidifying the melt with the core 150 inserted has elapsed. The time for solidifying the melt may be selected depending on the melt material.

Figure 15:
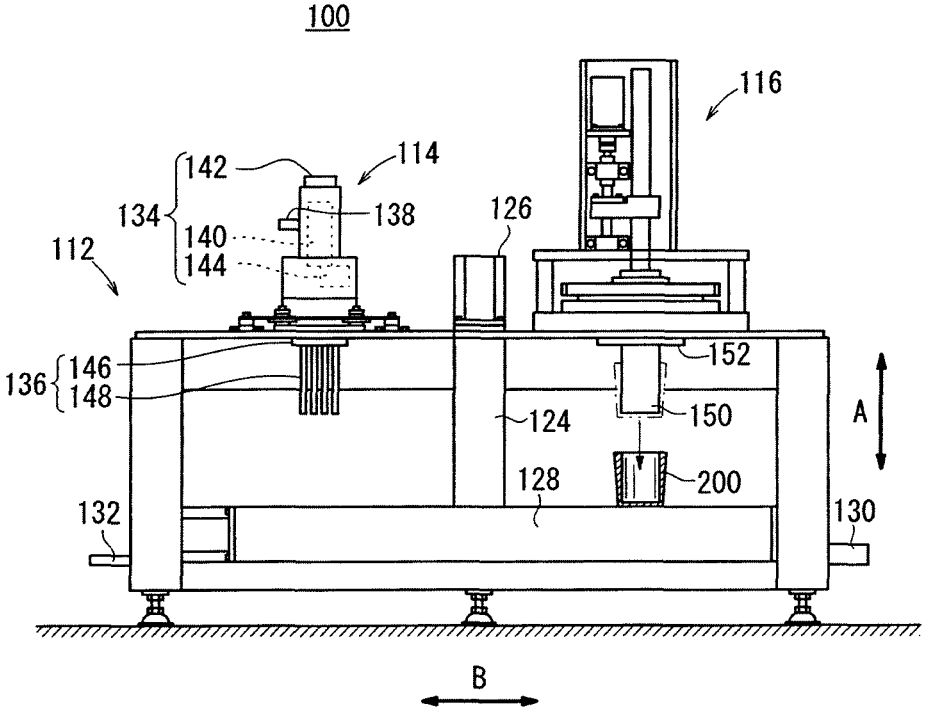
FIG. 15 is a view showing the step of removing the core from the casting.
Figure 16:
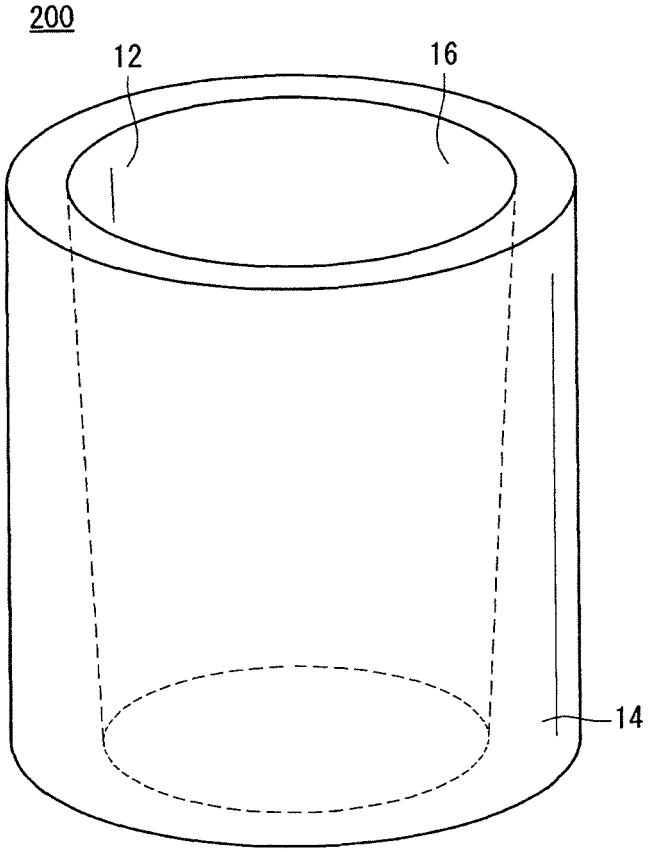
FIG. 16 is an overall, schematic, perspective view showing an unfinished sleeve obtained by cooling and solidifying the melt.

As shown in FIG. 15, the core inserting unit 116 is operated by the stripping control part 162, so that the core 150 is removed from the casting 200 (the step S7). Specifically, the stripper ring 152 is moved toward the conveying mechanism 128 by the stripping control part 162. As shown in FIG. 16, the casting 200 has a cavity corresponding to the inverted trapezoidal cone shape of the core 150, and the inner wall 12 forming the cavity has a tapered surface gradually increasing from the lower end to the upper end.

Then, the casting 200 is transferred to a working process region by the conveyance control part 158 (the step S8). In the working process, the inner wall 12 and the outer wall 14 are subjected to a predetermined finishing process such as a grinding process. As a result, the sleeve shown in FIG. 1 is obtained. This control routine is completed at the end of the step S8.

In the production apparatus 100 having the above structure, the elevating mechanism 124 and the elevating motor 126 corresponds to the elevating means, and the conveying mechanism 128 and the conveying motor 130 corresponds to the conveying means. In the control routine of the present embodiment, the step S2 corresponds to the vibration applying step, and the step S5 corresponds to the core inserting step.

In the slide member production apparatus 100 of the present embodiment, the melt is introduced into the vessel 120 placed on the stage 122 in the first position, and then the vibrating needles 148 are inserted into the melt by raising the stage 122. The vibration produced in the vibration generator 134 is transmitted through the support 146 to the vibrating needles 148, and thereby is applied to the melt at the low frequency. Then the crystallization phase nuclei are generated in the high-temperature region of the melt.

In fact, by controlling the oscillation frequency of the vibration generator 134 at 20 to 1000 Hz, the Fe—Mn-based intermetallic compound can be crystallized in the grain shape, and the eutectic Si can be made fine with the greatest diameter of 10 μm or less in a two-dimensional surface. The reason therefor is considered as follows. In the case of using the above oscillation frequency of 20 to 1000 Hz, a large number of embryos can be generated, and an energy sufficient for growing the embryos into the crystal nuclei and for solidifying the nuclei can be applied. Furthermore, in this case, it is assumed that since the melt is vibrated in the completely liquid state, each nucleus can be prevented from being incorporated into another nucleus during the growth of the crystallization phases.

After the melt is vibrated for the predetermined vibrating time, the stage 122 is returned to the first position, and then transferred from the first position to the second position, and raised such that the core 150 is inserted into the melt. Then, the melt is pressed by the core 150 and rapidly flows into the space between the outer surface of the core 150 and the inner surface of the vessel 120, whereby the outer surface of the core 150 is covered with the melt (see FIG. 13). Thus, formation of cold shut can be prevented from being generated in the sleeve 10. In the melt, the portion in contact with the outer surface of the core 150 is cooled at the high cooling rate. The portion is rapidly cooled by the core 150, whereby the fine hard metal crystal grains can be generated in the portion. In the metal structure of the sliding surface (the inner surface) of the sleeve 10, the crystallization phases and crystal grains are fine hard phases with a diameter of 10 μm or less. Thus, in this embodiment, the slide member having the highly abrasion-resistant sliding surface can be produced by the simple apparatus.

In the production apparatus 100 of the present embodiment, the rotor 140 and the eccentric 144 are integrally rotated to produce the vibration in the vibration generator 134. The vibration produced in the vibration generator 134 is transmitted through the support 146 to the vibrating needles 148. Since the vibrating needles 148 extend in the rotation axis direction of the rotor 140, they are moved in the transverse direction. Therefore, the entire melt can be uniformly vibrated at a relatively large amplitude, and the crystallization phase nuclei can be efficiently formed.

Furthermore, in the production apparatus 100 of the present embodiment, the vibrating needles 148 and the core 150 can be easily inserted into the melt by raising and lowering the stage 122. The vessel 120 can be transferred to the first and second positions more easily with the conveying means than those without the conveying means. When the first and second positions are adjacent to each other, the entire production apparatus 100 can have a smaller size, the vessel 120 can be transferred in a shorter time, and the cycle time can be shorter, than when they are distant (unadjacent).

In general, a cylinder block may be cast around a sleeve by die casting (high-pressure die casting) to make the cylinder block containing integrally molded sleeve and cylinder block main body. When the sleeve and the cylinder block main body have different metal structures, they exhibit different thermal expansion properties in casting, so that the adhesion therebetween is often deteriorated. In the present embodiment, since the vessel 120 is composed of the heat insulation material, the portion, which is in contact with the vessel 120, in the melt is cooled at a low cooling rate. Thus, when the sleeve 10 is enveloped by die casting to produce a cylinder block, the outer wall 14 of the sleeve 10 and a cylinder block main body can have approximately the same metal structure, and thereby can be sufficiently bonded.

Figure 17:
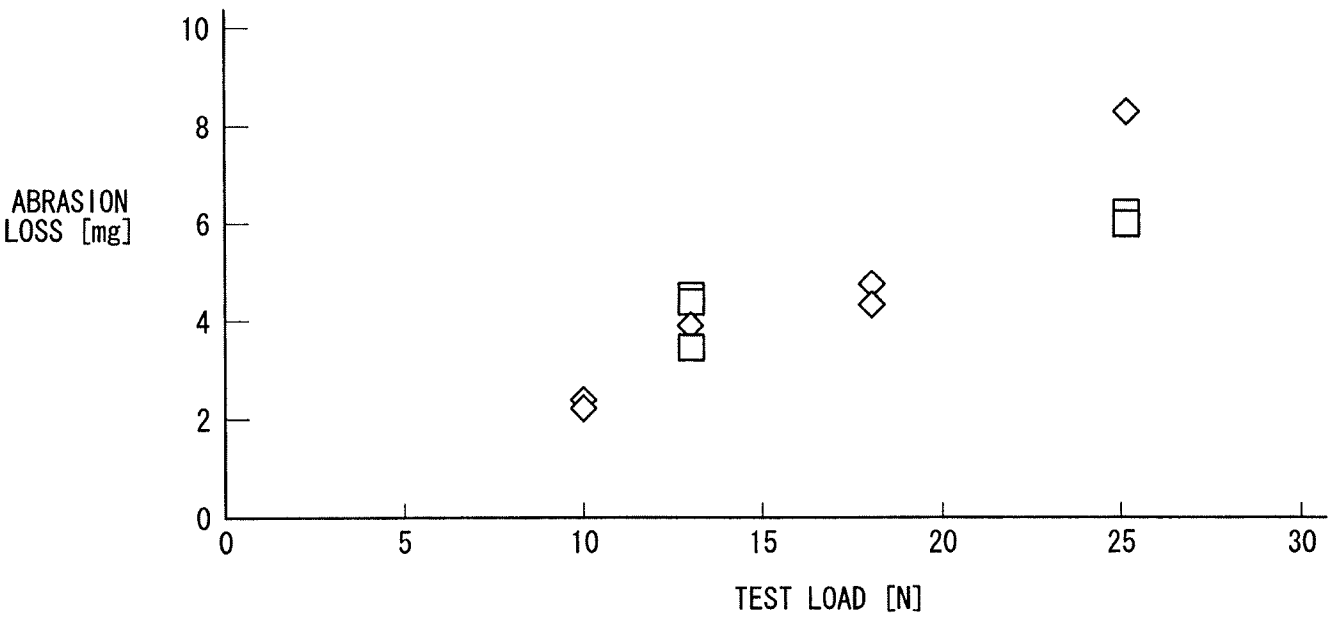
FIG. 17 is a graph showing the results of a test for evaluating the abrasion resistances of the sleeve according to the present embodiment and a sleeve obtained by a conventional gravity casting process.

The sleeve 10 obtained by the above production method was subjected to an abrasion resistance test. Also a sleeve according to a comparative example, obtained from an Al alloy melt by a conventional gravity casting process, was subjected to the test. The results are shown in FIG. 17. In the abrasion resistance test, the sliding surface of each sample had an arithmetic average roughness (Ra described in JIS B 0601 (2001)) of 3 μm. A member, slidably in contact with the sliding surface, was reciprocated 1500 times at a stroke of 45 mm and a sliding speed of 200 mm/second. Then, the abrasion loss of the sliding surface was measured. FIG. 17 is a graph showing the relation of the abrasion loss to load.

In FIG. 17, white squares represent the measurement results of the sleeve 10 according to the present embodiment, and white rhombuses represent the measurement results of the sleeve according to the comparative example. It is clear from FIG. 17 that the sleeve 10 according to the present embodiment exhibits a small abrasion loss even under a large load. In other words, the sleeve 10 is excellent in abrasion resistance.

The present invention is not limited to the above embodiment, and various modifications and changes may be made therein. The present invention can be applied to a slide member other than the sleeve for the cylinder block. The shape of the slide member may be not the cylindrical shape but a quadrangular prism shape. In this case, also the core has a quadrangular prism shape.

The material of the core is not limited to the copper-based material, and may be appropriately changed as long as the melt can be cooled by the core. A refrigerant may be enclosed in the core to cool the melt. In this case, the core may be composed of a copper-based material, and the melt cooling property of the core can be improved.

The vibrating needle is not limited to the above structure. For example, the material and shape of the vibrating needle may be arbitrary selected from those described in Table 1. The vibrator may have a cooling mechanism containing a refrigerant tube (not shown) as described in Japanese Laid-Open Patent Publication No. 2008-155271.

TABLE 1

| | | |
|---|---|---|
| Number | 1 or more | |
| Material | Metal or ceramic (surface-treated by plating, thermal spraying, PVD, CVD, etc. if necessary) | |
| Shape | Rod or plate | |
| | Cross section | Circle, ellipse, polygon, or combination thereof |
| | Longitudinal | Straight, tapered, accordion, or combination thereof |

It is to be understood that the Al alloy casting of the present invention is not limited to the sleeve 10 produced in the above embodiment. For example, the Al alloy casting may be a plate-shaped member.

In the case of producing the plate-shaped member, the core is not needed in the step of solidifying the melt. In this case, a so-called chiller may be used to increase the cooling rate.

In the above embodiment, the Al alloy contains Mn, so that the Fe—Mn-based intermetallic compound is crystallized. The Al alloy may be free of Mn, and in this case the iron is crystallized in the state of pure Fe or an intermetallic compound with another metal.

Although certain preferred embodiments of the present invention have been shown and described in detail, it should be understood that various changes and modifications may be made therein without departing from the scope of the appended claims.

What is claimed is:

1. A method for producing an aluminum alloy casting, comprising the steps of:

pouring a melt of an aluminum alloy containing Fe and Mn into a vessel, vibrating the melt in a completely liquid state using a vibrator at a frequency of 20 to 1000 Hz until the melt is cooled to a solidification starting point of the melt, stopping vibrating of the melt when the melt is cooled to the solidification starting point, and further cooling the melt at a cooling rate higher than a cooling rate at which the melt has been cooled to the solidification starting point, thereby solidifying the melt to obtain an aluminum alloy casting, wherein a metal structure of at least one surface in the aluminum alloy casting contains the Fe in the state of a grain of an Fe—Mn based intermetallic compound, and the metal structure further contains a eutectic silicon having a greatest diameter of 10 μm or less in a two-dimensional surface.

2. A method according to claim 1, wherein when the melt is cooled to the solidification starting point, a core having a temperature lower than that of the melt is inserted into the melt, whereby the cooling rate is increased and a cavity corresponding to the shape of the core is formed in the aluminum alloy casting.

3. A method according to claim 2, wherein in the melt, a portion in contact with the core is cooled at a cooling rate of 30° C./second or more, and a portion farthest from the core is cooled at a cooling rate of 10° C./second or less.

4. A method according to claim 2, wherein the aluminum alloy casting is a sleeve having an inner wall and an outer wall, and the inner wall has the at least one surface.

* * * * *